US011662088B1

(12) United States Patent
Jiang

(10) Patent No.: US 11,662,088 B1
(45) Date of Patent: May 30, 2023

(54) STAGE LIGHT WITH DEFOGGING DEVICE

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/829,041

(22) Filed: May 31, 2022

(30) Foreign Application Priority Data

Mar. 31, 2022 (CN) ..... 202220732058.5

(51) Int. Cl.
*F21V 29/504* (2015.01)
*F21V 29/60* (2015.01)
*F21W 131/406* (2006.01)

(52) U.S. Cl.
CPC ..... *F21V 29/60* (2015.01); *F21V 29/504* (2015.01); *F21W 2131/406* (2013.01)

(58) Field of Classification Search
CPC ..... F21W 2131/406; F21V 29/504; F21V 29/506; F21V 29/60; F21V 29/67; F21V 29/673; F21V 29/677
See application file for complete search history.

(56) References Cited

U.S. PATENT DOCUMENTS

2017/0328535 A1* 11/2017 Yagi ..... F21V 29/504

FOREIGN PATENT DOCUMENTS

| | | | |
|---|---|---|---|
| CN | 209325525 | U | 8/2019 |
| CN | 214535865 | U | 10/2021 |
| CN | 216113497 | U | 3/2022 |
| WO | WO2017/173429 | A1 | 10/2017 |
| WO | WO2020/037979 | A1 | 2/2020 |

* cited by examiner

*Primary Examiner* — Sean P Gramling
(74) *Attorney, Agent, or Firm* — Muncy, Geissler, Olds & Lowe, P.C.

(57) ABSTRACT

A stage light with a defogging device includes a light head, in which a mounting plate for fixing a light source and a supporting plate for mounting optical lens are arranged. At a light outlet of the light head a light emitting lens is provided, a light source cavity is formed by the supporting plate, the mounting plate and a side wall of the light head. A blower is arranged in the light source cavity, which is configured to guide airflow into space between the supporting plate and the light emitting lens through an air guiding element. Hot airflow in the light source cavity is guided into the space between the supporting plate and the light emitting lens, so that the temperature of the space between the supporting plate and the light emitting lens is increased, thereby reducing a temperature difference in the light head to avoid water fog.

13 Claims, 3 Drawing Sheets

STAGE LIGHT WITH DEFOGGING DEVICE

CROSS REFERENCE TO RELATED APPLICATIONS

The present application claims priority from Chinese Patent Application No. 202220732058.5 filed on Mar. 31, 2022, all of which are hereby incorporated herein by reference.

TECHNICAL FIELD

The present invention relates to the technical field of stage lights, and more particularly, relates to a stage light with a defogging device.

BACKGROUND

In the technical field of stage lights, the higher requirements for lighting effects of the stage there are, the higher power of a light source in the light head will be. Accordingly, in the working process of the stage light, the light source can generate a large amount of heat when projecting light beams, resulting in higher temperature near the light source. However, the temperature near a light emitting lens is similar to the temperature of the external environment, thereby causing a large temperature difference inside the light head, accordingly leading to accumulation of water fog on the side of the light emitting lens close to the light source, which greatly affects the lighting effect of the stage light. In addition, the water frog generated inside the light head is difficult to remove.

SUMMARY

The present invention provides a stage light with a defogging device, which reduces a temperature difference in a light head and thus prevents the water frog on a light emitting lens.

The stage light with a defogging device according to the present invention includes a light head, inside which a mounting plate for fixing a light source and a supporting plate for mounting an optical lens are arranged in the light head. At a light outlet of the light head, a light emitting lens is provided. A light source cavity is formed by the supporting plate, the mounting plate, and an inner side wall of the light head. A blower is arranged in the light source cavity, which is configured to guide airflow into space between the supporting plate and the light emitting lens through an air guiding element.

According to the present invention, with the configuration of the blower disposed in the light source cavity formed by the mounting plate, supporting plate, and an inner side wall of the light head, hot airflow in the light source cavity is guided into the space between the supporting plate and the light emitting lens through the air guiding element, so that the temperature of the space between the supporting plate and the light emitting lens is increased, thereby reducing a temperature difference in the light head, thus avoiding water fog at the end surface of the light emitting lens close to the light source, at the same time, lowering the temperature in the light source cavity to assist in heat dissipation of the light source.

According to at least one embodiment, a plurality of light sources and a plurality of optical lenses are provided, and respective light sources correspond to respective optical lenses one to one. A light guide is disposed between each light source and optical lens. With the configuration of the light guide arranged between each light source and optical lens, light beams emitted by the light source are collimated, so that the optical lens projects light beams collimated by the light guide, the light emitting effect thus is improved.

According to at least one embodiment, the air guiding element is configured to guide airflow at an air outlet of the blower to the light emitting lens. With such way, the airflow is directly guided to the light emitting lens, so that the efficiency of temperature increasing of the light emitting lens heated by the hot airflow is increased, thereby reducing water fog on the light emitting lens.

According to at least one embodiment, an annular air duct around the light emitting lens is further included. The air guiding element is connected with the annular air duct, and the side wall of the annular air duct close to the center of the light emitting lens is provided with a plurality of air exhaust holes. In such a way that an annular air duct is provided around the light emitting lens with a plurality of air exhaust holes, the hot airflow in the air guiding element can flow uniformly from the air exhaust hole to the light emitting lens, so that the light emitting lens is uniformly heated to avoiding too high or too low local temperature.

According to at least one embodiment, the annular air duct includes a surrounding plate extending from the inner side wall of the light head, and a sealing bottom plate for sealing a space between the surrounding plate and the side wall of the light head. The annular air duct is formed by the surrounding plate, the sealing bottom plate and the side wall of the light head. With the configuration of the sealing bottom plate for sealing the surrounding plate and the side wall of the light head, the airflow can only be discharged through the air exhaust hole after entering the annular air duct, thereby improving the air guiding efficiency.

According to at least one embodiment, the air exhaust hole is located in the surrounding plate, and the sealing bottom plate is provided with an air inlet communicated with the air guiding element, which allows airflow in the air guiding element to enter the annular air duct through the air inlet, and then to be discharged through the air exhaust hole in the surrounding plate.

According to at least one embodiment, the diameter of the air exhaust hole gradually decreases along the air outlet direction. With such configuration, the airflow in the annular air duct enters from the end with a large diameter of the air exhaust hole, so that the airflow can enter the air exhaust hole more easily. The diameter of the air exhaust hole gradually decreases along the air outlet direction, so that the airflow can be discharged from the end with a small diameter, which increases the outflow speed of the airflow, thus achieving higher heating efficiency of the light emitting lens.

According to at least one embodiment, the cross section of the annular air duct gradually decreases along the airflow flowing direction. In such configuration, the airflow enters from the side with a large cross-sectional area and gradually flows to the side with a small cross-sectional area, which is beneficial for increasing the flow velocity of the airflow and improves the heating efficiency.

According to at least one embodiment, a side of the surrounding plate close to the light emitting lens abuts against the periphery of the light emitting lens. In such configuration, the air exhaust hole in the surrounding plate is closer to the light emitting lens, which facilitates guiding the airflow to the light emitting lens, but also limits waggling of the light emitting lens in a plane where the light emitting lens is located, achieving a limiting function.

According to at least one embodiment, a flat air nozzle communicated with the air guiding element is further included, and an included angle formed by the air outlet direction of the flat air nozzle and the plane where the light emitting lens is located is less than 45 degrees. In such configuration, the airflow from the air nozzle can be blown to the light emitting lens, ensuring that the airflow from the air nozzle has large contact area with the light emitting lens, thus improving the heating efficiency.

According to at least one embodiment, at least two blowers are arranged. With two blowers provided, on the one hand, more airflow in the light source cavity is enabled to flow to the space between the supporting plate and the light emitting lens, which accelerates reducing the temperature difference in the light head, on the other hand, airflow circulation in the light head is accelerated, which improves the heat dissipation efficiency in the light source cavity.

According to at least one embodiment, in order to avoid shielding light emitted by the light source, the blower is mounted on the inner side wall of the light head.

The air exhaust holes are preferably uniformly arranged. In such simple way, the airflow in the annular air duct is uniformly blown to the light emitting lens, so that the light emitting lens is further heated uniformly.

According to at least one embodiment, the air guiding element is provided with a first air guiding section communicated with the air outlet of the blower, and a second air guiding section with one end communicated with an air outlet of the first air guiding section and the other end communicated with the air inlet of the sealing bottom plate. The second air guiding section is preferably integrally formed with the side wall of the light head. By being integrally formed with the side wall of the light head, it is advantageous to simplify mounting and thus lower the production cost.

DETAILED DESCRIPTION

Figure 1:
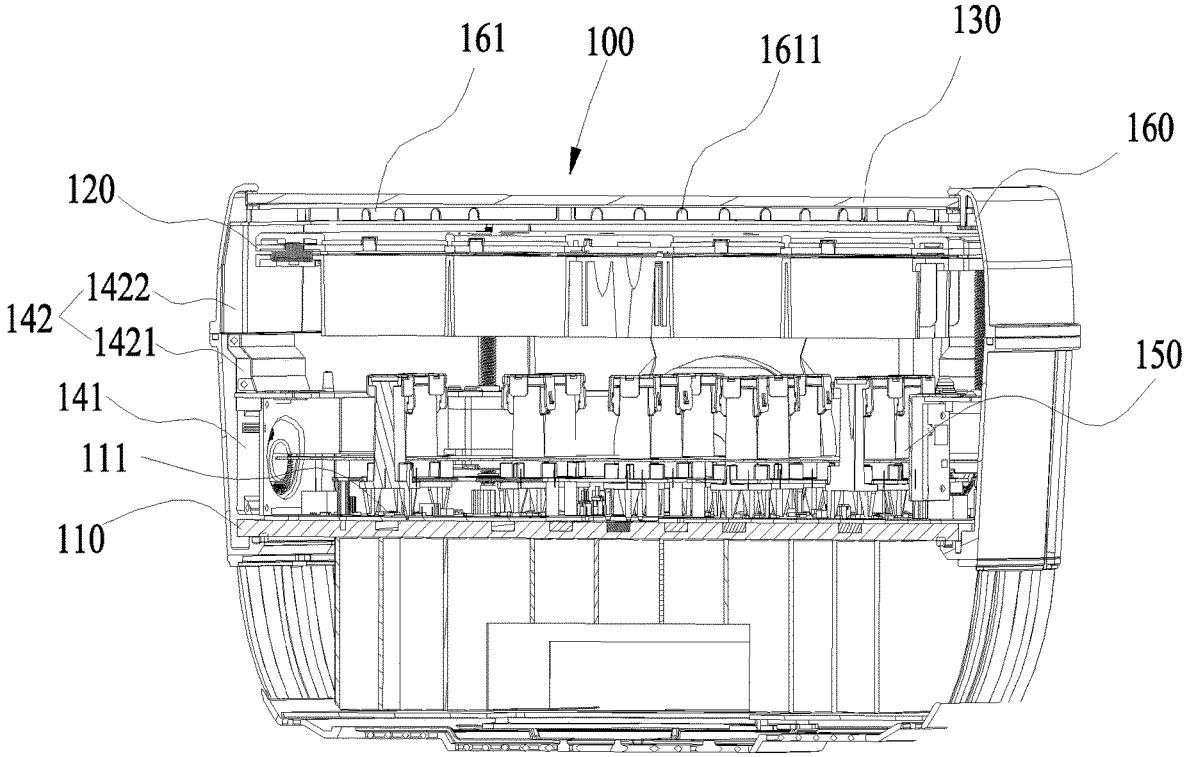
FIG. 1 is a structural diagram of a light head according to one embodiment of the present invention.
Figure 2:
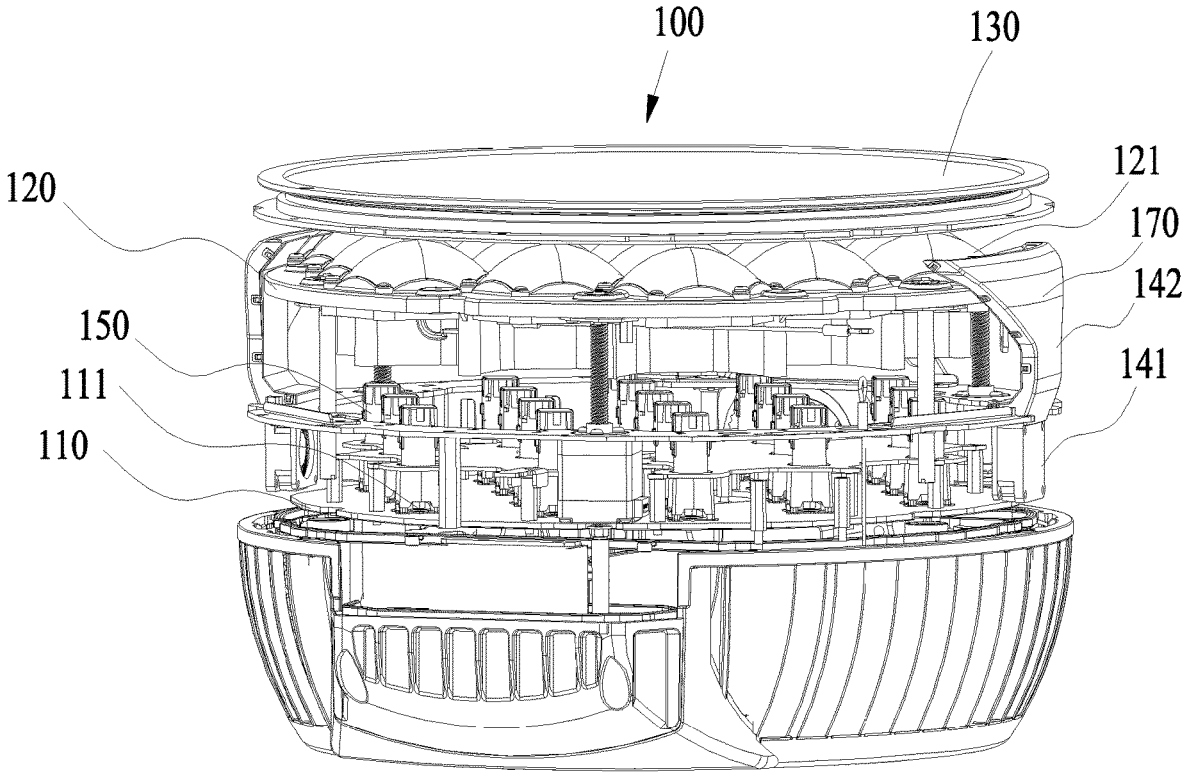
FIG. 2 is a structural diagram of a light head according to another embodiment of the present invention.
Figure 3:
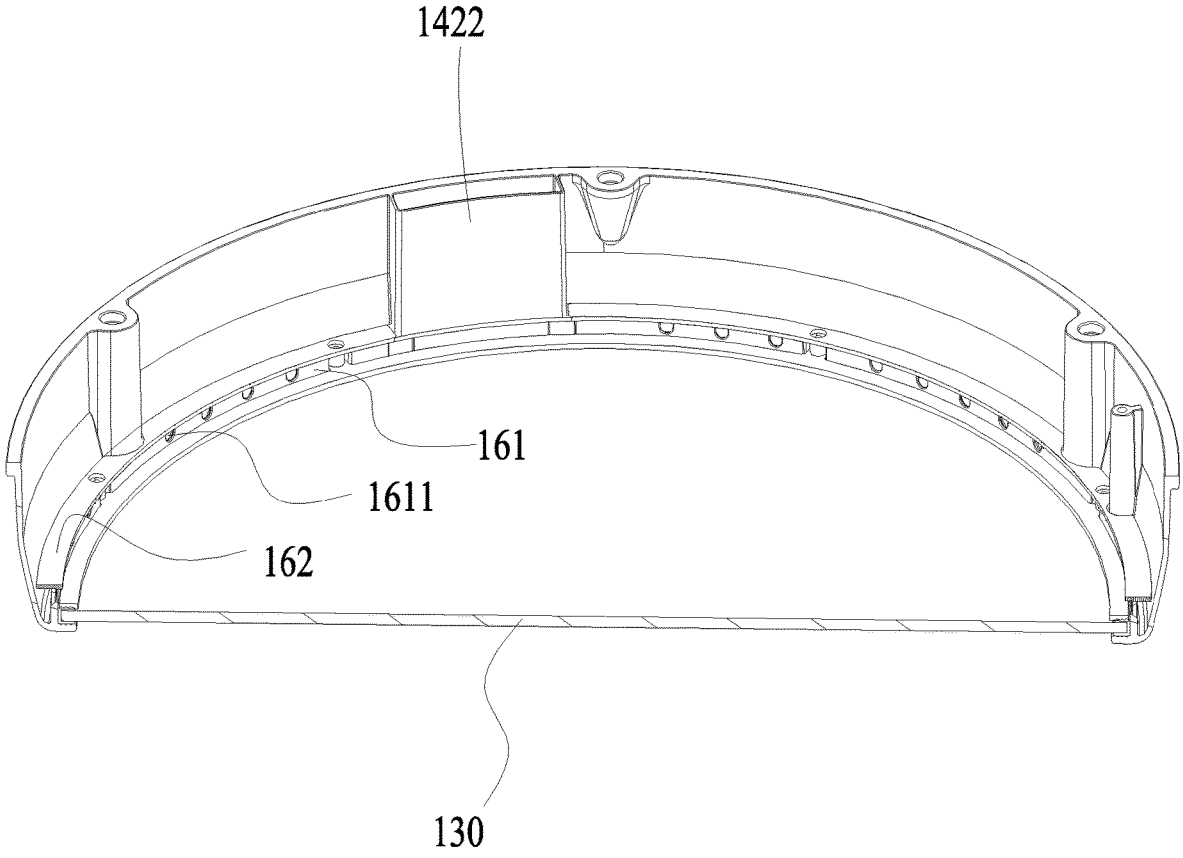
FIG. 3 is a structural diagram of an annular air duct and a light emitting lens according to one embodiment of the present invention.

The accompanying drawings are for exemplary illustration only, and should not be construed as limitations on this patent. In order to better illustrate the present embodiment, some parts of the accompanying drawings may be omitted, enlarged or reduced, and do not represent the size of actual products. For those skilled in the art, it is understandable that certain well-known structures and descriptions thereof may be omitted in the drawings. The positional relationship described in the drawings is only for exemplary illustration, and should not be construed as a limitation on this patent As shown in FIG. 1 to FIG. 3, a stage light with a defogging device according to at least one embodiment is provided, which has a light head 100. Inside the light head 100, a mounting plate 110 for fixing a light source 111 and a supporting plate 120 for mounting an optical lens 121 are provided. At a light outlet of the light head 100, a light emitting lens 130 is provided. A light source cavity is formed by the supporting plate 120, the mounting plate 110, and an inner side wall of the light head 100, in which at least one blower 141 is arranged. The blower 141 guides airflow into space between the supporting plate 120 and the light emitting lens 130 through an air guiding element 142.

In the present embodiment, hot airflow inside the light source cavity is guided into the space between the supporting plate 120 and the light emitting lens 130 through the air guiding element 142 by means of the blower 141 disposed in the light source cavity formed by the mounting plate 110 and the supporting plate 120, so that the temperature between the supporting plate 120 and the light emitting lens 130 is increased, thereby reducing a temperature difference in the light head 100, thus avoiding water fog at the end surface of the light emitting lens 130 close to the light source 111, meanwhile lowering the temperature in the light source cavity to assist in heat dissipation of the light source.

Referring to FIG. 1 and FIG. 2, according to one embodiment, a plurality of light sources 111 and a plurality of optical lenses 121 are provided, and respective light sources 111 correspond to respective optical lenses 121 one to one. A light guide 150 is arranged between each light source 111 and optical lens 121. With the configuration of the light guide 150, light beams emitted by the light sources 111 are collimated, so that the optical lens 121 projects light beams collimated by the light guide 150, the light emitting effect is thus improved.

The blower 141 is preferably mounted on the inner side wall of the light head 100 so as to avoid shielding light emitted by the light source 111.

As shown in FIG. 1 and FIG. 2, preferably, the blower 141 is mounted close to the light source 111. The temperature of the airflow close to the light source 111 is higher, the blower 141 is provided close to the light source 111 so that high-temperature airflow is extracted from the interior of the light source cavity by the blower 141, and is further guided into the space between the supporting plate 120 and the light emitting lens 130 through the air guiding element 142. Such configuration can not only accelerate the heat dissipation efficiency of the light source 111, but also reduce the temperature difference in the light head 100.

As shown in FIG. 1 and FIG. 2, according to some embodiments of the present invention, the air guiding element 142 is configured to guide airflow at an air outlet of the blower 141 to the light emitting lens 130. That is, the airflow is directly guided to the light emitting lens 130, which improves the efficiency of the temperature increasing of the light emitting lens 130 heated by the hot airflow and thus further reduces water fog on the light emitting lens 130.

Referring back to FIG. 1, the air guiding element 142 is preferably disposed along the inner wall of the light head 100 so as to avoid shielding the light emitted by the light source 111 and avoid interfering with the stroke of a moving element in the light head 100.

As shown in FIG. 1, according to one embodiment of the present invention, an annular air duct 160 disposed around the light emitting lens 130 is further provided. The air guiding element 142 is connected with the annular air duct 160, and the side wall of the annular air duct 160 close to the center of the light emitting lens 130 is provided with a plurality of air exhaust holes 1611. With the configuration of the annular air duct 160 around the light emitting lens 130, which provides a plurality of air exhaust holes 1611, the hot airflow in the air guiding element 142 can flow uniformly from the air exhaust holes 1611 in the periphery of the light emitting lens 130 to the light emitting lens 130, so that the light emitting lens 130 can be uniformly heated, thus avoiding too high or too low local temperature.

The air exhaust holes 1611 are preferably uniformly arranged so that the airflow in the annular air duct 160 is uniformly blown to the light emitting lens 130, the light emitting lens 130 is thus further uniformly heated.

Referring to FIG. 1 and FIG. 3, according to one embodiment, the annular air duct 160 includes a surrounding plate 161 extending from the inner side wall of the light head 100, and a sealing bottom plate 162 configured to seal space between the surrounding plate 161 and the side wall of the light head 100. The annular air duct 160 is formed by the surrounding plate 161, the sealing bottom plate 162 and the side wall of the light head 100. With the the sealing bottom plate 162 for sealing the surrounding plate 161 and the side wall of the light head 100, the airflow can only be discharged through the air exhaust hole 1611 after entering the annular air duct 160, which improves the air guiding efficiency.

The surrounding plate 161 is preferably integrally formed with a housing of the light head 100 to simplify mounting and reduce mounting errors, which can reduce the cost of the entire light.

According to one embodiment, a side of the surrounding plate 161 close to the light emitting lens 130 abuts against the periphery of the light emitting lens 130. Such configuration not only enables the air exhaust hole 1611 in the surrounding plate 161 to be closer to the light emitting lens 130, which facilitates guiding the airflow to the light emitting lens 130, but also limits waggling of the light emitting lens 130 in a plane where the light emitting lens 130 is located, which achieves a limiting function.

As shown in FIG. 3, according to one embodiment, a side of the surrounding plate 161 close to the light emitting lens 130 is further provided with an elastic member abutting against the periphery of the light emitting lens 130. Such configuration can prevent damage to the light emitting lens 130 due to rigid contact with the surrounding plate 161.

As shown in FIG. 3, according to one embodiment, the air exhaust hole 1611 is located in the surrounding plate 161, and the sealing bottom plate 162 is provided with an air inlet communicated with the air guiding element 142, allowing airflow in the air guiding element 142 to enter the annular air duct 160 through the air inlet, and then to be discharged through the air exhaust hole 1611 in the surrounding plate 161.

As shown in FIG. 3, according to one embodiment the diameter of the air exhaust hole 1611 gradually decreases along the air outlet direction. In such way, the airflow in the annular air duct 160 enters from the end with a larger diameter of the air exhaust hole 1611, ensuring easy entrance of the airflow into the air exhaust hole 1611. Then, the airflow is discharged from the end with a smaller diameter, due to the gradual decreasing of the diameter of the air exhaust hole 1611 along the air outlet direction. The outflow speed of the airflow thus is increased, thereby achieving higher heating efficiency of the light emitting lens 130.

According to one embodiment, the cross section of the annular air duct 160 gradually decreases along the airflow flowing direction. That is, the airflow enters from the side with a large cross-sectional area and gradually flows to the side with a small cross-sectional area. Such configuration is beneficial for increasing the flow velocity of the airflow and thus improves the heating efficiency.

Preferably, the air guiding element 142 is provided with a first air guiding section (1421) communicated with the air outlet of the blower 141, and a second air guiding section (1422) with one end communicated with an air outlet of the first air guiding section (1421) and the other end communicated with the air inlet of the sealing bottom plate 162. The second air guiding section (1422) is preferably integrally formed with the side wall of the light head 100. By being integrally formed with the side wall of the light head 100, it is advantageous to simplify mounting and thus lower the production cost.

Referring to FIG. 2, according to one embodiment, a flat air nozzle 170 communicated with the air guiding element 142 is further provided. An included angle of the air outlet direction of the flat air nozzle 170 and the plane where the light emitting lens 130 is located is less than 45 degrees. Such configuration allows the airflow from the air nozzle to be blown to the light emitting lens 130, and makes the airflow from the air nozzle in large contact area with the light emitting lens 130.

According to one embodiment, at least two blowers 141 are arranged. With configuration of two blowers 141, on the one hand, more airflow in the light source cavity is enabled to flow to the space between the supporting plate 120 and the light emitting lens 130, which accelerates reducing the temperature difference in the light head 100, on the other hand, airflow circulation in the light head 100 is accelerated, which improves the heat dissipation efficiency in the light source cavity.

According to a preferable embodiment, three blowers 141 are arranged and used for accelerating the circulation of the airflow, which improves the heating efficiency of the light emitting lens 130.

Preferably, the blowers 141 are uniformly arranged around the inner side wall of the light head 100 to make flow guiding more uniform.

Preferably, the light emitting lens 130 includes light-transmitting glass or transparent acrylic plate. The light-transmitting glass or transparent acrylic plate allows light beams generated by the light source 111 to pass through.

Obviously, the above-mentioned embodiments of the present invention are only examples for clearly illustrating the present invention, rather than limiting the mode of implementation of the present invention. For those of ordinary skill in the art, changes or alterations in other different forms can also be made on the basis of the above description. It is not needed and also not possible to list all the modes of implementation here. Any modification, equivalent replacement, improvement, etc. made within the spirit and principle of the present invention shall be included within the protection scope of the claims of the present invention.

The invention claimed is:

1. A stage light with a defogging device, comprising a light head, in which a mounting plate configured for fixing a light source and a supporting plate configured for mounting an optical lens are arranged, wherein at a light outlet of the light head a light emitting lens is provided, a light source cavity is formed by the supporting plate, the mounting plate and an inner side wall of the light head, and a blower is arranged in the light source cavity, which is configured to guide airflow into space between the supporting plate and the light emitting lens through an air guiding element;

wherein the stage light further comprising an annular air duct disposed around the light emitting lens, wherein the annular air duct is communicated with the air guiding element, and a side wall of the annular air duct close to a center of the light emitting lens is provided with a plurality of air exhaust holes;

wherein the annular air duct comprises a surrounding plate extending from the inner side wall of the light head and a sealing bottom plate configured for sealing a space between the surrounding plate and the inner side wall of the light head, and the annular air duct is formed by the surrounding plate, the sealing bottom plate and the inner side wall of the light head.

2. The stage light with the defogging device according to claim 1, wherein at least one light source and at least one optical lens are provided, respective light source being corresponding to respective optical lens one to one, and a light guide is provided between each light source and optical lens.

3. The stage light with the defogging device according to claim 1, wherein the air guiding element is configured to guide airflow at an air outlet of the blower to the light emitting lens.

4. The stage light with the defogging device according to claim 1, wherein the air guiding element is provided with a first air guiding section communicated with an air outlet of the blower, and a second air guiding section with one end communicated with an air outlet of the first air guiding section and the other end communicated with an air inlet of the sealing bottom plate.

5. The stage light with the defogging device according to claim 4, wherein the second air guiding section is preferably integrally formed with the inner side wall of the light head.

6. The stage light with the defogging device according to claim 1, wherein the air exhaust hole is arranged in the surrounding plate, and the sealing bottom plate is provided with an air inlet communicated with the air guiding element.

7. The stage light with the defogging device according to claim 1, wherein a diameter of the air exhaust hole gradually decreases along an air outlet direction.

8. The stage light with the defogging device according to claim 1, wherein a cross section of the annular air duct gradually decreases along an airflow flowing direction.

9. The stage light with the defogging device according to claim 1, wherein the air exhaust holes are uniformly arranged.

10. The stage light with the defogging device according to claim 1, wherein a side of the surrounding plate close to the light emitting lens abuts against a periphery of the light emitting lens.

11. The stage light with the defogging device according to claim 1, further comprising a flat air nozzle communicated with the air guiding element, wherein an included angle formed by the air outlet direction of the flat air nozzle and a plane where the light emitting lens is located is less than 45 degrees.

12. The stage light with the defogging device according to claim 1, wherein at least two blowers are arranged.

13. The stage light with the defogging device according to claim 1, wherein the blower is mounted on the inner side wall of the light head.

* * * * *